United States Patent [19]

Sorin

[11] 4,275,443

[45] Jun. 23, 1981

[54] BOARD GAME COMPUTING DEVICE

[76] Inventor: Andrei Sorin, 7 St. Dennis Dr., Suite 1107, Don Mills, Ontario, Canada, M3C 1E5

[21] Appl. No.: 36,374

[22] Filed: May 7, 1979

[51] Int. Cl.[3] ..... G06F 15/44

[52] U.S. Cl. ..... 364/410; 273/237; 273/248; 340/323 R; 340/365 R

[58] Field of Search ..... 364/410, 411, 709; 235/92 GA; 340/323 R, 365 R; 273/237, 242, 248

[56] References Cited

U.S. PATENT DOCUMENTS

| | | | |
|---|---|---|---|
| 4,036,500 | 7/1977 | Kiernan | 273/237 |
| 4,082,285 | 4/1978 | Bathurst | 364/410 X |
| 4,092,527 | 5/1978 | Luecke | 364/709 |

*Primary Examiner*—Jerry Smith

*Attorney, Agent, or Firm*—Ridout & Maybee

[57] ABSTRACT

A backgammon calculator has a keyboard laid out in the configuration of a backgammon board, with keys for entering men on the points and bar to set up a game position, and further keys in the home and outer boards between the points for amending the game position, for identifying the player which has the next turn or whose position is to be calculated, and for initiating a number of different calculations as to a player's position. The data entered and the results of the calculations are displayed on a digital read-out.

7 Claims, 4 Drawing Figures

BOARD GAME COMPUTING DEVICE

FIELD OF THE INVENTION

This invention relates to electronic board game devices and calculator devices for utilization in conjunction with board games, of the type in which game data is entered into the device utilizing a keyboard. More particularly, but not exclusively, the invention relates to a backgammon aid.

BACKGROUND OF THE INVENTION AND REVIEW OF THE PRIOR ART

Modern electronic developments have made it possible to provide economically the computing power required in devices intended either to make the calculations and assessments associated with sophisticated board games such as backgammon or chess, or to provide an electronic opponent for a human player of the game. Naturally some form of interface has to be provided between the device and the human user or player, and in commercial devices would desirably take the form of some type of simulation of the board of the game being played. Particularly in a calculating device, it would be desirable for data entry keys to be positioned on this board simulation at points related to the data being entered, e.g., on a backgammon board, entries relating to specific points should be entered through keys on or adjacent those points.

Unfortunately, this would hitherto have required the use of a specially designed keyboard in order to provide the desired key locations, and such a keyboard is not economically feasible unless manufactured in very large quantities, far greater than are required for the unit cost of the necessary electronic components to fall to an economically acceptable level. For this reason devices of the kind under discussion utilize a separate keyboard of more or less conventional design in conjunction with a video or illuminated display indicating the data entered.

An object of the present invention is to provide a game board simulator with provision for key entry of game data at appropriate points on the board, which utilizes readily available non-specialized keyboard components.

A further object of the invention is to provide a backgammon calculator with provision for entry of data concerning the men at appropriate locations on a simulated board which nevertheless is based upon the use of readily available mass-produced components.

SUMMARY OF THE INVENTION

The objects of the invention are achieved by utilizing for the mechanical construction of the board the same conception as is already commonly utilized in the electronic architecture of devices of the type under discussion. Such devices, particularly when of a dedicated nature, utilize a programmed read-only memory or memories to store programmes for implementing the functions of the device in a central processing unit. The memory or memories are usually standard devices or parts of standard devices which comprise matrices of memory cells, selected locations in which are caused to assume a different state from the remainder either during manufacture of the device or by a separate operation subsequent to manufacture.

Analogously, a somewhat similar approach is adopted in providing the keyboard of a device in accordance with the present invention. At least one keyboard contact matrix having multiple rows and columns of contact sets is provided, but only selected contact sets in the rows and columns are provided with keys, these keys being distributed over the matrix in a mask providing a simulation of the game board in positions where it is desired to enter data. More than one keyboard contact matrix may be provided beneath the board, in order to provide a desired key distribution in the mask.

A backgammon calculator in accordance with the invention comprises input means in the form of a keyboard laid out on an external surface of the calculator to resemble a backgammon board with data entry keys on the points and bar of the board, and additional function keys at locations other than on the points and bar, output means in the form of a digital display visible from outside the calculator, and data processing means in the form of a microcomputer having random access and read only memories, the read only memory of the microcomputer being programmed with routines selected by a first group of said function key to accept data from said data entry keys so as to enter said data in said random access memory whereby to record therein the number of men of each colour on each point and the bar in a playing position in a game of backgammon, and with routines selected by a second group of function keys, located on said keyboard other than on the points or bar, to perform calculations related to the probable subsequent progress of the game and to display the results of said calculations on said digital display.

SHORT DESCRIPTION OF THE DRAWINGS

In the accompanying drawings:

FIG. 1 is a perspective external view of a backgammon calculator in accordance with the invention, FIG. 2 is a block diagram of the electronic configuration of the calculator, FIG. 3 is a longitudinal cross-section through the calculator, and FIG. 4 is a plan view of a keyboard contact matrix of a standard commercially available type, illustrating the selective positioning of keys relative thereto.

DESCRIPTION OF THE PREFERRED EMBODIMENT

Figure 1:
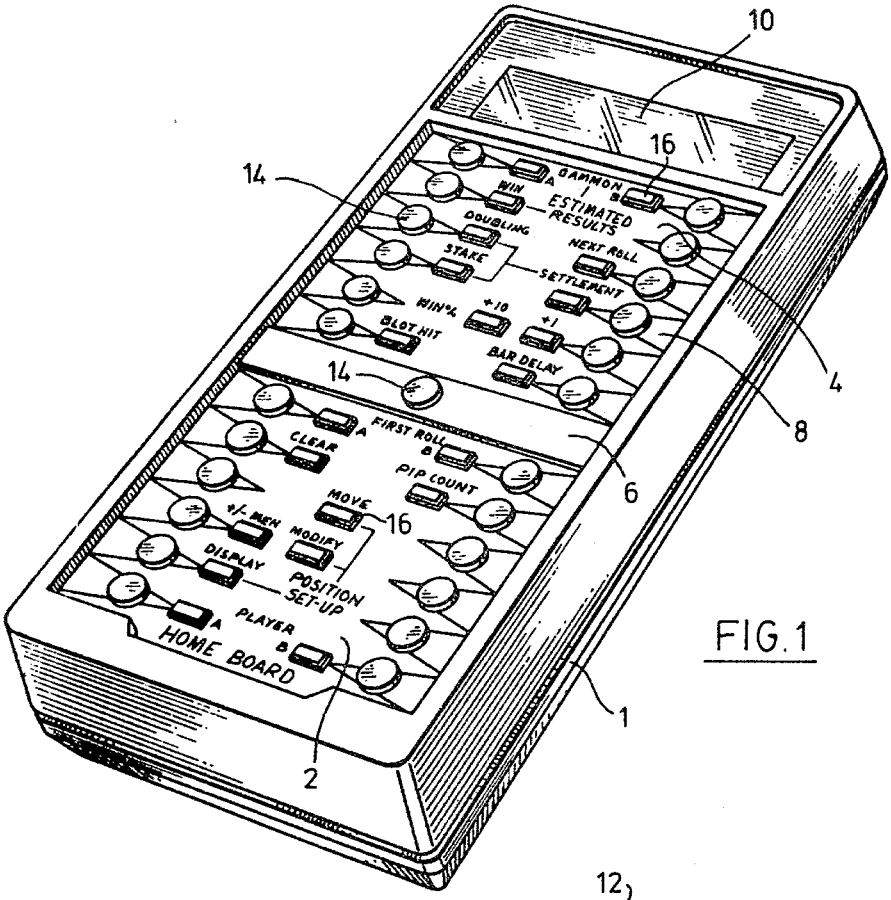
Figure 3:
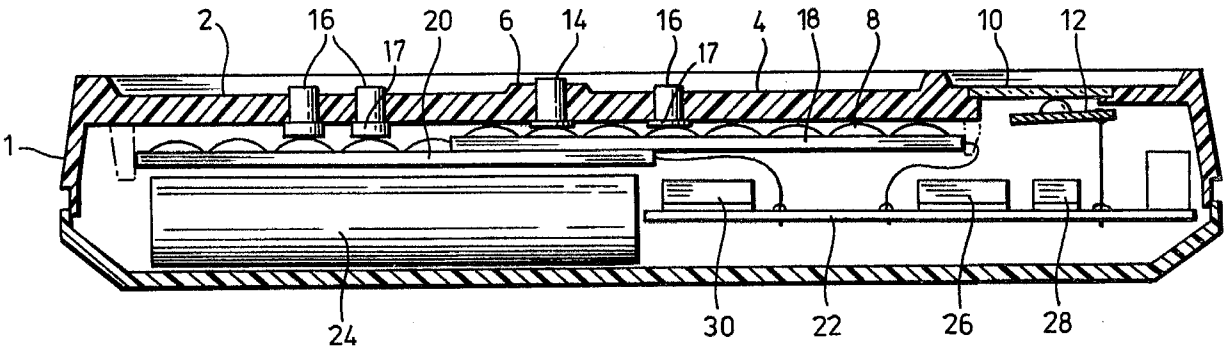

Referring to FIG. 1, the calculator exhibits to the user a case 1 having an upper surface laid out to simulate a backgammon board having a home board 2, an outer board 4, a bar 6, and the customary points 8 on either side of the board, all positioned and contrastingly coloured in accordance with custom. Beyond the outer board is a window 10, through which is visible a multi-digit display 12 (see FIG. 3) of any appropriate type. In the example being described, the display is a light emitting diode display, but liquid crystal, fluorescent or other suitable displays may of course be utilized with suitable drive circuitry.

Received in apertures in the upper surface of the case are a number of key pads 14 and 16 retained against escape by retaining flanges 17. The keys 14 are round and are located on each of the points 8 and on the bar 6. The keys 16 are rectangular and are located in the areas between the tables, away from the points and bar. The keys 14 are used to make entries relating to specific points or the bar, whilst the key 16 are function keys utilized to designate specific operations and their location is not critical except for convenience. Thus function keys utilized to designate one player or the other are conveniently arranged adjacent that player's tables and keys having related functions may be grouped together, as is described further below.

Figure 4:
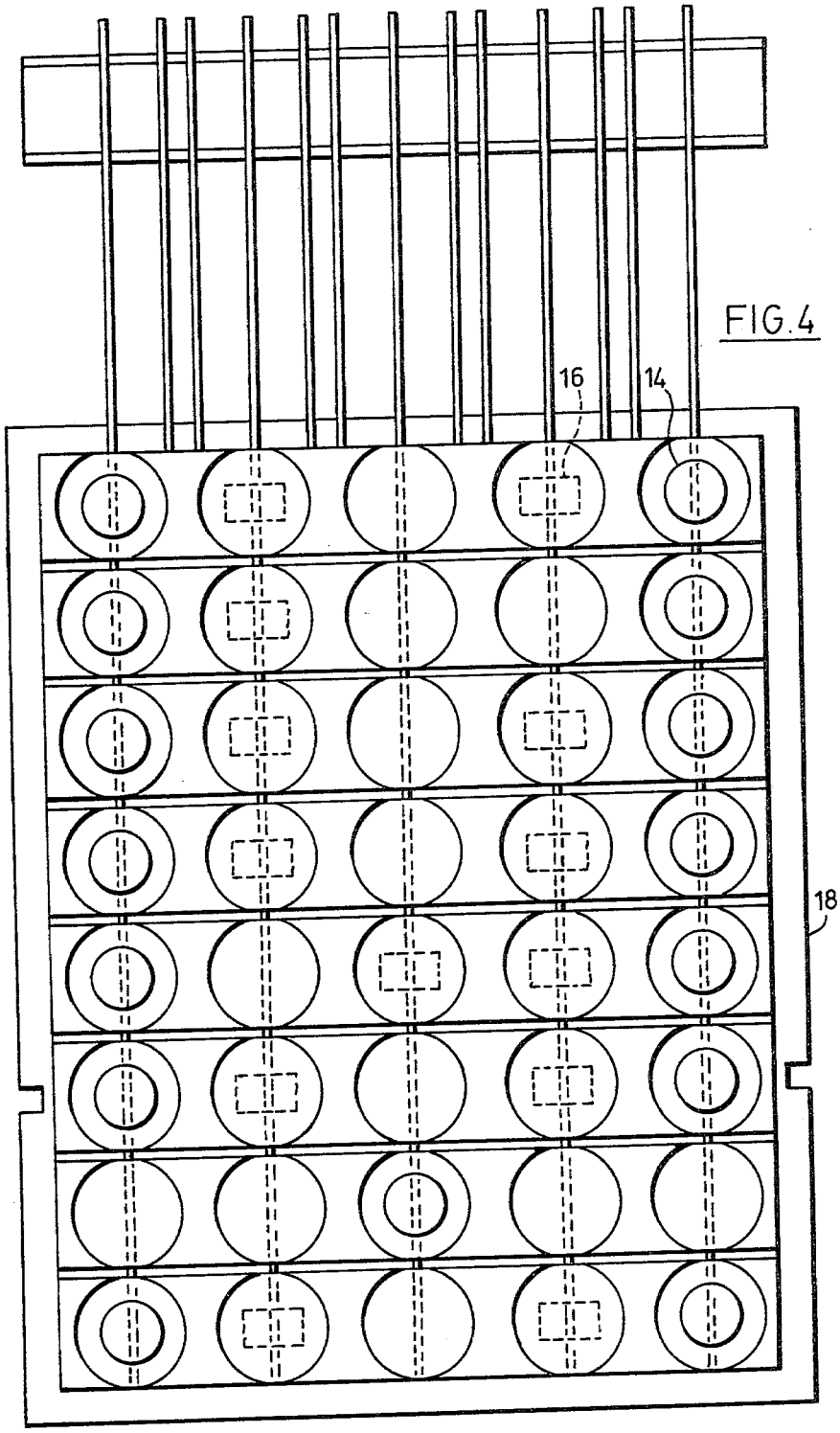

Beneath the upper surface of the case are mounted two keyboard contact matrices 18 and 20. These are standard forty position units having the contacts arranged in eight rows and five columns, such as those sold under the designation 11 KS 119 and the trade mark KLIXON by Texas Instruments Inc. Since only 13 rows of key positions are in fact required, the keyboards are mounted in overlapping relationship as shown in FIG. 4, and the top three rows of contacts in matrix 20 are not utilized. Moreover, only those contacts which lie beneath wanted locations are utilized, the top surface of the case 1 acting as a mask locating the key pads 14 and 16 in positions compatible with the layout of the top surface as a backgammon board.

Figure 2:
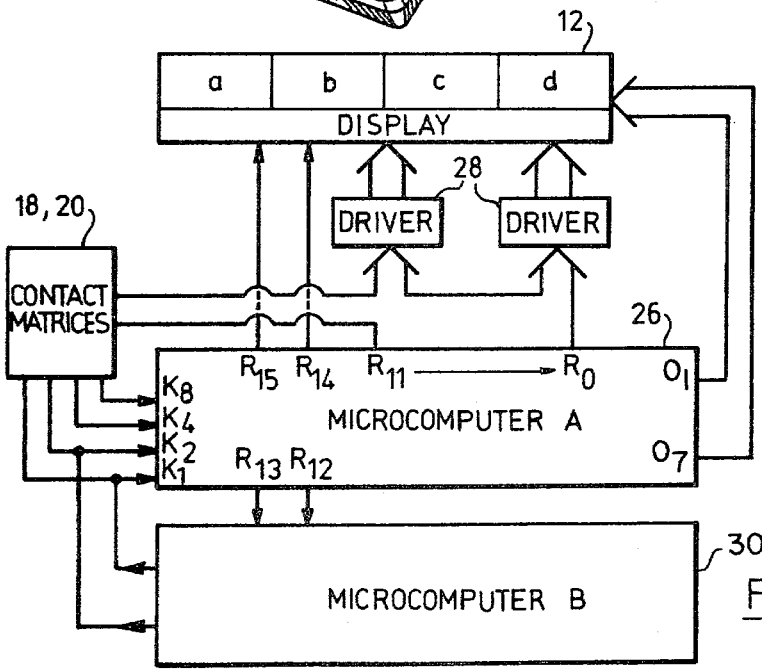

The electronic circuitry of the calculator is concentrated on a printed circuit board 22 within the casing, powered from a battery pack 24 which may be rechargeable and provided with conventional provision for recharging through a jack (not shown). This circuitry is illustrated in broad terms in FIG. 2. Entries made through the key pads 14, 16 (hereinafter referred to as keys for convenience) are transmitted to a microcomputer A implemented on a chip 26. This chip is conveniently that designated TMS 1300 by Texas Instruments Inc. and its electrical specifications and capabilities are set forth in detail in the "TMS 1000 Series Data Manual" published in 1976 by Texas Instruments Incorporated, the text and drawings of which manual is incorporated herein by reference. The chip includes both read only and random access memories, as described and illustrated in the manual.

The chip 26 has 16 "R" outputs $R_0$–$R_{15}$ of which $R_0$–$R_{11}$ are multiplexed, and 8"O" outputs, only seven of which, $O_1$–$O_7$ are used. The outputs $R_0$–$R_{11}$ drive the common cathodes of 12 seven-segment digits of the display 12 through digit driver chips 28, whilst the segment anodes of each digit except that on the extreme left are driven by the outputs $O_1$–$O_7$. The decimal point anodes of the display are driven by output $R_{15}$, and selected segment anodes of the left hand digit by output $R_{14}$. The outputs of chip 26 are thus capable of driving a twelve digit display with decimal points.

Inputs to the chip from the contact matrices 18, 20 are provided on four input lines $K_1$, $K_2$, $K_4$, $K_8$, which are multiplexed to provide inputs from each position in a four column 12 row matrix by the multiplexed outputs $R_0$–$R_{11}$. It will be noted that whilst such an arrangement can accept inputs only from a $12\times4$ matrix, the matrices 18 and 20 form a $13\times5$ matrix. This problem can be overcome since there are never more than four key pads in any row of the matrix, several rows contain only three key pads and one, that beneath the bar 6, contains only one. The key pads are arranged so that a single connection is common to the central column of the matrix 18 and the second column from the left in both matrices, a single connection is common to the central column of matrix 20 and the second column from the right in both matrices, and a single connection is common to the row beneath the bar 6 and the fourth one from the bottom of matrix 20. Thus by careful arrangement of the key pads relative to the matrices, a lesser number of input ports to the microcomputer chip 26 is required than might be expected from the size of the matrix.

The read only memory of the microcomputer A is mask programmed to carry out a number of calculation functions in accordance with position data fed to its random access memory by use of the key pads 14 and function commands fed to it by use of the key pads 16. The complexity of some of the calculations which may be required in the game of backgammon is such as to exceed the random access and read only memory capacity of the chip 26. The chip 26 is programmed to recognize function commands which may give rise to such calculations, and in response thereto to transmit the board condition, as entered through the key pads 14 and the commands through the outputs $R_{12}$, $R_{13}$ to a second microcomputer chip 30 which since it has no other functions, has sufficient memory capacity available to perform the calculations and return the results to the chip through the input $K_1$, and $K_2$.

It is not proposed to discuss the programmes of the chips 26 and 30 in detail, since this can follow conventional principles and the programmes themselves form no part of the present invention. It is believed sufficient to indicate the functions to be achieved by this programming since suitable algorithms for performing these individual functions can be developed by those skilled in the programming art and converted into suitable programmes employing usual skills and the information contained in the TMS 1000 Series Data Manual. These functions and their implementation will be seen to be of a generally similar class to the calculation functions implemented in other specialized calculators, for example those providing statistical functions. The functions either enable the entry of data and/or operate on data already entered, and cause the result of the entry and for the operation to be shown on the display 10.

Referring now to the functions initiated by the different keys 16, these will be described with reference to the labels shown applied to the home and outer boards 2 and 4 in FIG. 1, and the result displayed on the display 10, which is organized in four portions a, b, c and d. Portion a merely consists of a symbol "C" to indicate that the result displayed relates to one player (player A) rather than the other (player B), or the symbol "a" to indicate that the data displayed relates to player A. Portions b and c can both provide three figure numerical displays, whilst portion d can provide a four figure display, a "Pc" display to indicate that portion C displays a percentage, or a "b" display to indicate that data entered relates to player B.

Data is entered into the calculator by means of the keys 14 under control of the group of keys 16 labelled "POSITION SET-UP", which cause the calculator to execute preprogrammed routines in which it accepts the data and stores it in the random access memory of chip 26. The PLAYER "A" and "B" keys at the bottom of the home board cause the calculator to accept data as to the position of one player or the other, or to display results relating to that player. The calculator must be loaded with data for both players, but data must be loaded and results displayed sequentially. Assuming that PLAYER "A" or "B" key has been pressed, use of the MODIFY key enables men of that player to be entered on or removed from the points 8 and bar 6 by depressions of appropriate keys 14. During this process, the identity of the player is indicated on display portion a or d, the number of men entered on the particular point accessed on portion b, and the total number of men entered on portion c. Whether men are entered or removed is determined by use of the +/− key which is actuated to display a minus sign on display portion a or d when men are to be removed. The calculator is programmed to detect and ignore impermissible entries, e.g., the entry of more than 15 men of one player. The MOVE key performs the same function as the MODIFY key except that the +/− mode is automatically switched between strokes of the keys 14 to allow fast movement of men from one position to another. The CLEAR key operates to clear the entire position of the player currently being displayed, without affecting the other player.

The DISPLAY key causes the total number of men of players A or B to be displayed at portions b and c, and indicates who has the first roll as entered by one of the FIRST ROLL keys, by displaying a decimal point in display portion b or c. Pressing one of the keys 14 after the display key causes the display to show at portion b and c the number of men on that point or on the bar, and to whom they belong.

Once the positions of both players have been programmed using the above discussed keys, the remaining keys 16 may be utilized to carry out calculations on the basis of the programmed positions. The PIP COUNT key displays on portions b and c the total number of men and their pip count for player A or B as previously entered at the bottom of the home board. The FIRST ROLL "A" and "B" keys are used to instruct the calculator which player has the first roll, starting from the programmed position, prior to use of the WIN, GAMMON and BAR DELAY keys which make calculations related to the future progress of the game.

The WIN key initiates a calculation resulting in a display which identifies the player at display portion a, the estimated average number of dice rolls needed to finish moving and bearing off all men (assuming that no additional men are hit and all rolls can be fully played) on portion b, and the probability of winning the game in percentage points on portions c and d. The GAMMON "A" and "B" keys initiate a calculation of the estimated average number of dice rolls required by player A or B to win or avoid a gammon, depending on whether the key selected identifies the player or his opponent. The assumptions made in the calculation and the mode of display are the same as for the WIN key. The BAR DELAY key initiates a calculation resulting in a display on display portion b of the number of men on the bar belonging to the player identified on display portion a, and at display portion c, the estimated number of dice rolls wasted whilst entering those men.

The NEXT ROLL key, if pressed before the WIN or GAMMON keys, displays the player, the number of dice combinations, and the percentage chance for a win, a gammon or avoiding a gammon in the next roll at display portions a, b, and c, d respectively. If pressed before the bar delay key, similar information is displayed in respect of the chances of successfully entering all the men on the bar in the next roll.

The BLOT HIT key initiates a calculation lead to the display at display portions b and c, d respectively, the number of dice combinations and the probability in percentage points of hitting at least one opponent blot on the next roll of dice.

The player "A" or "B" keys can be used after a calculation to display the result of the same calculation for the other player.

By repeatedly depressing the DOUBLING and STAKE keys, a settlement result can be adjusted for a stake unit value of 1 to 9 and doubling cube values of 1, 2, 4 . . . 64. The display constantly indicates the player, the cube value, the stake and the settlement points at display portions a, b, c and d, respectively.

By repeatedly pressing the +10 and +1 keys, any winning percentage can be entered on display portions c and d, whereafter pressing of the SETTLEMENT key calculates and displays at d the number of points to be won or lost in a settlement.

It will of course be understood that the combination of functions described above is only one of many which is possible within the scope of the invention, and is described by way of example only.

In the example described data and the results of calculations are displayed using three or four figure displays and to only one decimal place or the nearest percentage point. This is believed quite sufficient for all practical purposes and enables the desired four display portions to be implemented on a twelve digit display whilst always maintaining at least one unactivated digit between display portions. It will be found from a review of the foregoing description that it will never be necessary for two adjacent display portions to show simultaneously a number containing more than two digits, thus maintaining the desired separation between display portions.

Whilst the foregoing description has referred to conventional keyboards in which key pads are depressed so as mechanically to actuate contacts, it will be apparent that the principles of the invention are equally applicable to keyboard constructions of the touch or proximity types in which the desired contacts are established electronically on application of a digit of the user to a key location designated on the keyboard.

Whilst the embodiment described uses two contact matrices and two microcomputer chips, it will be appreciated that similar results could be achieved using a single matrix or chip subject to the availability of suitable devices at an economic price. Moreover, whilst a backgammon calculator has been described it will be appreciated that the keyboard construction would also have utility in a device adapted for the playing of backgammon in which a user pitted him or herself against a suitably programmed computer in or associated with the device. Keyboards for entry of positions in other board games could also be constructed using similar techniques within the scope of the appended claims.

The embodiments of the invention in which an exclusive property or privilege is claimed are defined as follows:

1. A backgammon calculator comprising input means in the form of a keyboard laid out on an external surface of the calculator to resemble a backgammon board with positional data entry keys on the points and bar of the board, and additional function keys at locations other than on the points and bar, output means in the form of a digital display visible from outside the calculator, and data processing means in the form of a microcomputer having random access and read only memories, the read only memory of the microcomputer being preprogrammed with routines selected by a first group of said function keys to accept data from said positional data entry keys so as to enter said data in said random access memory whereby to record therein the number of men of each colour on each point and the bar in a playing position in a game of backgammon, and with routines selected by a second group of function keys, located on said keyboard other than on the points or bar, to perform calculations related to the probable subsequent progress of the game and to display the results of said calculations on said digital display.

2. A calculator according to claim 1, comprising a further group of data entry keys in said keyboard to enter data relative to the game position other than the positions of the men, said keys comprising keys indicating which player's position is to be calculated, and which player has the next roll.

3. A calculator according to claim 2, wherein said further group of keys additionally comprises keys operable in association with any positional entry key to increment and decrement data stored in said random access memory relating to the number of men at the position identified by that positional entry key.

4. A calculator according to claim 3, further comprising a key operable alternately to increment and to decrement data relating to the number of men recorded in positions selected by two different positional entry keys, whereby to move men from one position to another in the game position stored in the memory.

5. A calculator according to claim 3, wherein the function keys and the further data entry keys are located in columns on the portions of the keyboard simulating the home and outer boards, between and in line with the keys on the points.

6. A calculator according to claim 1, wherein the keys co-act with at least one contact matrix below the keyboard whereby to enter data into said calculator, and wherein some at least of rows and columns of contacts in the matrices are connected in parallel whereby to bring keys which are physically above different rows or columns in the matrix into the same electrical row or column.

7. A calculator according to claim 1, wherein the digital display is adapted to display separately a plurality of items of data simultaneously.

* * * * *